US005880044A

United States Patent [19]

Shimiz

[11] Patent Number: 5,880,044

[45] Date of Patent: Mar. 9, 1999

[54] FIBER PRODUCT MADE OF ELVAN

[75] Inventor: Shigeo Shimiz, Saitama-ken, Japan

[73] Assignee: Mi Soo Seok, Seoul, Rep. of Korea

[21] Appl. No.: 864,433

[22] Filed: May 28, 1997

[30] Foreign Application Priority Data

May 28, 1996 [KR] Rep. of Korea ..... 1996-18297

[51] Int. Cl.[6] ..... B32B 5/16

[52] U.S. Cl. ..... 442/365; 523/122; 442/202; 442/117

[58] Field of Search ..... 428/364; 442/365, 442/202, 116, 117

[56] References Cited

U.S. PATENT DOCUMENTS

| | | | |
|---|---|---|---|
| 4,501,661 | 2/1985 | Karasawa | 210/223 |
| 5,221,289 | 6/1993 | Miyamatsu et al. | 8/646 |
| 5,593,626 | 1/1997 | Yagishita | 264/122 |

*Primary Examiner*—Christopher Raimund

[57] ABSTRACT

In the present invention elvan (a ceramic material) and a plastic are mixed and formed into a fiber. The fiber is made into non woven fabric products having antibacterial properties.

5 Claims, 4 Drawing Sheets

FIBER PRODUCT MADE OF ELVAN

BACKGROUND OF THE INVENTION

The present invention relates to a synthetic textile fiber, and more particularly to a synthetic textile fiber of a ceramic substance and an organic substance produced by mixing and melting elvan and a plastic material, in which elvan is a natural mineral material which radiates infrared rays and has antibacterial properties, and the plastic material is a polyester, an acrylic material, or the like.

A fiber is made from only a plastic material, and an antibacterial agent is artificially spread on the fiber. Accordingly, a chemical fiber or non woven fabric with antibacteria [HRT] properties is commonly used. The present invention relates to the production of a synthetic cotton or a non woven fabric, which is made from a synthetic textile fiber. The synthetic textile fiber is mixed with a natural material, thereby creating a synthetic cotton or the non woven fabric which has antibacterial properties and radiates infrared rays. Thus, the fiber produced by the present invention radiates infrared rays and has antibacterial properties. As a result, the fiber of the present invention differs from a conventional product in efficiency.

SUMMARY OF THE INVENTION

The present invention relates to a plastic cotton or a non woven fabric which radiates infrared rays, has a strong absorption due to porosity and has antibacterial properties of elvan. The present invention relates to a synthetic textile fiber having improved hygrascopicity and warmth due to infrared rays, and has a good touch due to a lowering of surface electric resistance. The sythetic textile fiber is used in various manufactures.

Since elvan is disclosed as a medicinal mineral for refining dermatopathy or a water in the Bon Cho Do Kung(a title of book, the book is published in Jong(name of nation) of China nine hundred years ago), elvan had been used for giving a strong absorption due to porosity or radiation of infrared rays. Elvan is further used for maintaining of freshness of a filter. The composition of elvan is crag belonging to quartz porphyry, but even a fine powder of 500 Mesh has a porosity such as a sponge. Further, regarding antibacterial properties, aluminosilicates (feldspar) contain elvan and have a composition of $KAlSi_3O_8$, $NaAlSi_3O_8$, $CaAl_2Si_2O_8$, or $MgAl_2Si_2O_8$, and so on, wherein a silicic acid($SiO_2$) has a streoscopic structure with the configuration of a tetrahedron(FIG. 1) $SiO_4$ three-dimensionally. In the structure, an aluminum is linked coordinately with a lone pair of oxygen atoms in a bridge shape(FIG. 2), a magnesium, a calcium, a sodium or a potassium atom is bonded in a terminus of the structure(FIG. 3).

If elvan is put in water or is contacted with moisture in air, the bond of the oxygen and the mg, Ca, Na or K is ionized a little, whereby —SiO radicals are generated at the terminus of the structure because of a ionic bond between oxygen and the Mg, Ca, Na or K. The existence of the —SiO radicals is clearly confirmed by an infrared spectrum of the elvan.

It is verified in many experiment that liberated $—SiO^-$ radicals are capable of absorbing iron ions, mercury ions, and so on. These radicals are also capable of absorbing pigments or bacilli. That is, as shown in the following formula, the absorption of $Fe^{3+}$, $Hg^{2+}$, and so on result from bonding with $—SiO^-$.

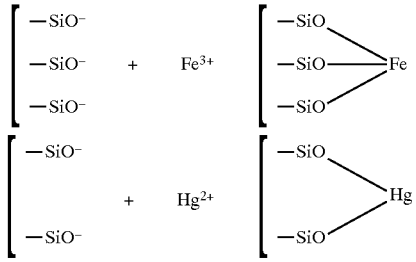

Further, it is regarded that the absorption of pigments or bacilli results from bonding with a postively charged nitrogen atom in a molecule of pigment or in a bacterial protein. Particularly, regarding bacilli, countless —N+— of mycelium are bonded with many $—SiO^-$ several times, the bond is assumed to be an absorption penomenon for capturing mycelium. In addition, a feldspar containing elvan becomes remarkably porous, has a much higher number of —SiO radicals than common feldspar, and has a remarkable absorption function. This is all because of weathering and melting.

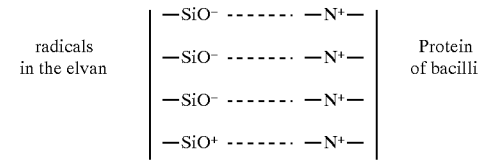

According to the above theory, it can be known that the generation of ion and the absorption function of elvan is increased more and more with increasingly fine powder.

In accordance with this theory, the present invention bonds a fine powder of elvan with a chemical fiber. Generally, the melting point of elvan is more than 800° C., and the melting point of a chemical fiber is 60°–90° C. Thus, when a fiber mixed elvan and resin is produced in a conventional process using heating and extrusion, the elvan is not melted, and the absorption capacity of elvan remains in the resin materials. The surface resin is raked out by extruding metal, and as a result, the elvan is exposed on the surface of the fiber.

After this, —SiO radicals liberated in the elvan exposed on the surface of the fiber accept a nitrogen atom at its residual electron, and due to this acceptance, the activity of bacilli is suppressed.

The present invention relates to the production of a chemical fiber absorbing bacilli such as saprophyte by porous structure, further suppressing the activity of bacilli by the above antibacterial properties, and maintaining a bacteriostatic condition for many hours. That is, the fiber mixed with elvan and the resin of the present invention has not only absorption function of a porous substance but also a scientific absorption function.

Further, elvan has another special property which is to radiate infrared rays. This ability can be confirmed by heat induced picture(reference-1). Also, if a wall in a room is coated with elvan, thereafter, the temperature in the room and the radiant heat of the wall as be measured. As a result, the radiation of far infrared rays of elvan has been confirmed (Table-1).

DETAILED DESCRIPTION OF THE INVENTION

Figure 1:
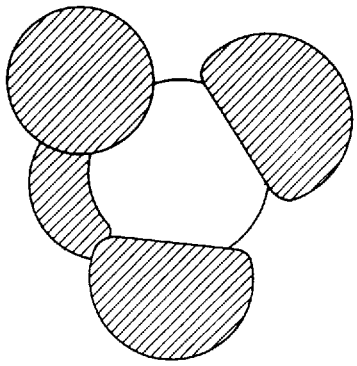
FIG. 1 is a schematic view of a regular tetrahedron of a $SiO_4$.
Figure 2:
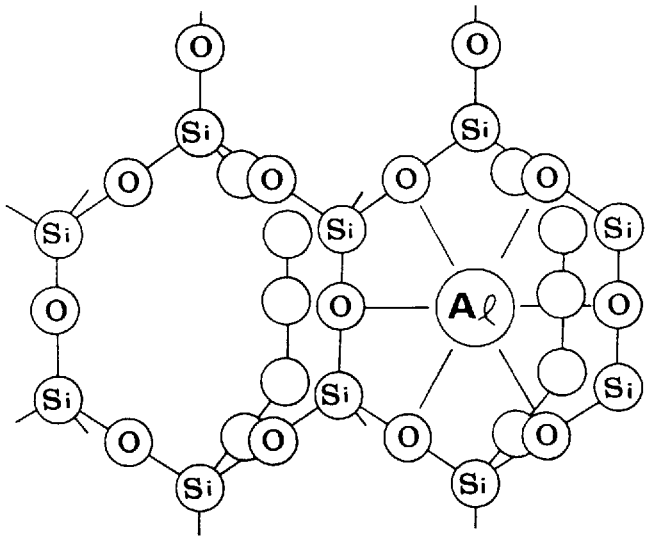
FIG. 2 is a schematic view showing the state of an aluminum atom linked coordinately with a lone pair of oxygen atoms in a bridge shape.
Figure 3:
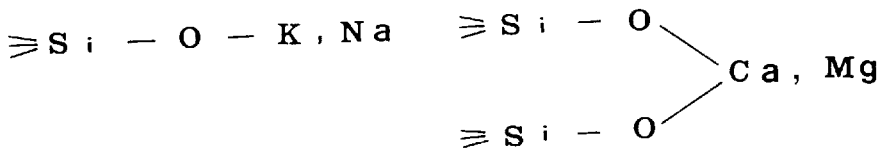
FIG. 3 is a schematic view showing the state of a magnesium, a calcium, a sodium or a potassium atom bonded at terminus of an aluminosilicate structure.
Figure 4:
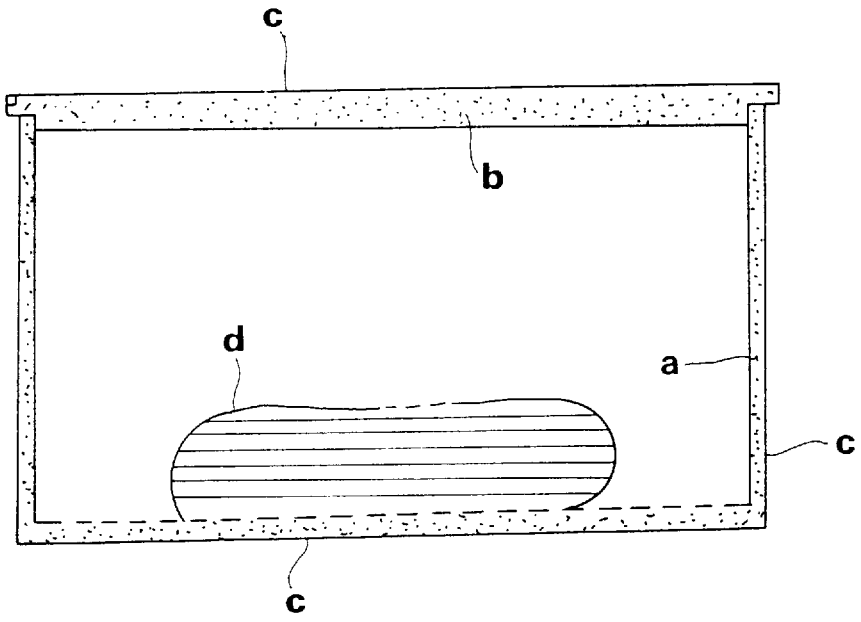
FIG. 4 is a view showing a box made of non woven fabric according to the present invention, whose surface is covered with aluminum boil, and in which frozen food is disposed.

In the present invention, cotton yarn made of an elvan is produced by the same process as a conventional process of making a chemical fiber.

The melting point of elvan is more than 800° C., and the melting point of plastic is 60–90° C. Therefore, when the two materials are mixed and heated at the melting point of the plastic, the plastic is liquefied but the elvan having a higher melting point is not melted, thus the elvan maintains a porosity, is dispersed into the liquefied plastic, and is complexed with the plastic. When mixed materials of the above condition are molded into fiber form by a plastic molding machine, the plastic is liquefied by heating at a temperature which is more than the melting point of the plastic materials, the elvan is dispersed into the liquefied plastic. In these conditions if pushed out through a die having an inside diameter suitable for molding cotton yarn, mixed liquid of elvan and plastic is pushed out to form a line in the air, in which the diameter of the line is identical with that of the inside diameter of the die, but if the mixed liquid is cooled below the melting point at the point it is pushed out, then it is solidified to yarn shape. The yarn shape is cut into required length, unwoven, and then cotton is produced. In this case, the diameter of the elvan powder must be ⅓ and less than the inside diameter of the die for extrusion molding. When the plastic and elvan are mixed with the ratio of 100 to 5, the diameter of the elvan required is 10 Microns for yarn of 6 denier.

Also, fiber for under wear requires a yarn of 2 denier. In this case, the diameter of the elvan powder must be 1 Micron or less.

The plastic complexed with the elvan is a thermoplastic resin such as nylon, vinylon, acrylpolypropylene, and so on, which are more suitable materials for molding. But, the fiber according to the present invention can be produced using polyester resin such as those in common chemical fibers. Besides, a warm mat radiating infrared rays can be produced by using urethane elastomer mixed with the fiber of the present invention, and the fiber of the present invention can be produced for filling materials in medical supplies.

EXAMPLE

To 5 Kg of saturated polyester beads with lower melting point, 0.3 Kg of elvan powder of 10 Micron diameter and 0.1 Kg of Ag ion antibacterial agent was added, then mixed and dispersed. Next, the resultant mixture is heated at 90° C. and extruded in adhering metal of 6 denier at a foremost tip in a heating extrusion molding machine. If so, the saturated polyester beads were dissolved to liquid, the elvan powder was dispersed in the liquid. As a result, a fiber dispersed with elvan powder was made from the mixture. When a surface of elvan powder on a surface of a fiber is extruded, polyester covering the surface of the fiber is removed by the metal, then a complex fiber having the natural efficiency of elvan was obtained. Non woven fabric can be produced easily using the complex fiber. Also fiber cloth can be easily produced by twisting the complex fiber. The produced fiber goods radiated infrared rays and had antibacterial properties. The function is confirmed by reference 1 and 2.

An affect of the present invention is that the fiber made of elvan has the special property which is the antibacterial property and the radiation of infrared rays, therefore, a field of use to the fiber is enlarged in comparison with conventional non woven fabric. The field of use according to the given properties is enlarged to the medical field, a field required to maintain freshness by restraining decay, clothing for protection against cold, sports clothing, filters for purification of water, an insulation field, a bedclothes field, and so on.

For example, the fiber of the present invention can be used for packing in the transportation of fish and vegetables. The commercial value of vegetables is very controlled by their freshness. To maintain a freshness, vegetables must be stored at low temperature, stay unbruised in transport, be prevented from ripening and ageing due to the absorption of generated etylene. To satisfy the above conditions, a packing material is required to have an adiabatic effect, a buffer effect, absorptivity and antibacterial properties. But, the non woven fabric according to the present invention satisfies all of the above requisites. Non woven fabric of the present invention has high absorptivity and anntibacterial properties, because non woven fabric of the present invention satisfies, the above objects. Non woven fabric of the present invention was attached inside of a box for the transport of vegetables, or vegetables are wrapped in the non-woven fabric of the present invention and the wrapped vegetables were placed in a transport box. These vegetables were maintained freshly for a long time. Above all, fine holes in the elvan contain moisture, thus the dryness of the vegetables can be protected. That is, the vegetables can be conserved freshly for a long time, thus the vegetables are not degraded in quality.

In the case of use in sports clothing, the warmth of the clothing improves extremely by infrared rays from elvan, and further the smell of sweat is eliminated by the antibacterial properties. Further, if used as cotton for a sleeping bag, the temperature is elevated for cold proofing. Also, sports clothing for reducing weight can be used in a special use.

The fiber is effective where it is used as a thawing container for frozen food. It is very difficult that frozen food is thawed to be the food with its original taste. Generally, contrary to a professional cook, if the frozen food is thawed, its taste deteriorates remarkably. Particularly, a thawing is difficult in summer.

When the frozen food is thawed in a refigerator, its taste is known to be favorable. Because, a temperature in a refrigerator is 3–5° C. in which ice is melted. Further, a decay of food is restrained at the temperature, thus a freshness of food is not lowered by a thawing. But, when frozen food is thawed, contained moisture is transpired and transpired moisture is attatched on a surface, rumples or fissures of food, in result, food tastes flat and becomes unsavory. Particularly, in case of a raw fish dish or meat becomes more tasteless. A raw fish is wrapped by absorbent cloths and is thawed in a refrigerator, then the cloths absorb a transpired moisture and eliminate taste flat, thus a professional cook uses the above method. But, the above method takes to a long time and is impractical at home.

When non-woven fabric of the present invention is used for thawing frozen food, the thawing time is very short. A box a and a cover thereof b made of non woven fabric of the present invention is wrapped by aluminum foil c in which frozen meat d is put, which is laid in air(1). Frozen meat is put in a vinyl bag, which is laid in a refrigerator(2) and which is laid in air(3). Thereinafter, thawing results in the three cases will be compared.

The above thawing tests were measured at an exterior temperature +35X of $^{0}$C21 According to the following table, in the case of the box made of non-woven fabric of the present invention(result (1)), the temperature in the box changed similarly with the temperature in the refrigerator, thus it took four hours to thaw the meat completely and the freshness of meat was maintained nearly. In the case of frozen meat in the refrigerator(result (2)), the surface of the meat was only soft and the meat was not thawed completely after four hours. In case of frozen meat of in air(result (3)), the surface temperature of the meat differed entirely with the inner temperature of the meat. And, the inner meat was frozen but the surface thereof was juicy and the color thereof was changing.

Here, the box made of non woven fabric was not given any artificial energy, further the temperature of the frozen meat was not elevated was maintained at 2° C. In accordance with these results, it is clear that frozen meat adiabated by non woven fabric of the present invention and aluminum foil was not influenced by exterior temperature and was thawed at the most suitable state which is effected by infrared rays.

| Case/Time lag (min) Thawing Temp (°C.) | 0 | 30 | 60 | 90 | 120 | 150 | 180 | 210 | 240 | 270 |
|---|---|---|---|---|---|---|---|---|---|---|
| (1) | −2 | 0.0 | 1.0 | 2.0 | 2.0 | 2.0 | 2.0 | 2.0 | 2.0 | 4.0 |
| (2) | −2 | −2 | −2 | — 1.5 | — 1.8 | — 0.0 | — 0.0 | 0.5 | 0.5 | 1.0 |
| (3) | −2 | 0.0 | 0.5 | 1.5 | 2.5 | 3.5 | 4.5 | 7.0 | 15.0 | 18.0 |

TABLE 1

The measurement of radient heat

| Receipt No. Data No. | Elvan of ChungDo mine 4 Samples of Germanium powder(G/Powder 4) | | | Wave Length | F = 0.7–3 , F = 3–7 , F = 7–14 | |
|---|---|---|---|---|---|---|
| Content No. | Temp. in the room ( ) | Temp. of the wall ( ) | F (W/ ) | F (W/ ) | F (W/ ) | BuYoung Bio Ceramic |
| 1 | 27.2 | 27.6 | | 0.278 | | |
| | 26.9 | 28.9 | | | 1.094 | |
| 2 | 27.1 | 30.2 | | 0.823 | | |
| | 27 | 30 | | | 1.433 | 1.311 |
| 3 | 27.2 | 35 | | 0.923 | | |
| | 27.1 | 35 | | | 2.793 | 2.501 |
| 4 | 27.2 | 40 | | 1.936 | | |
| | 27.2 | 40 | | | 4.537 | 3.606 |
| 5 | | | | | | |

Hong Won Engineering Co. Ltd.

What is claimed is:

1. A fiber product made of elvan comprising elvan powder, and a plastic material, wherein the fiber product is synthesized by mixing and melting the elvan powder and the plastic material.

2. The fiber product made of elvan according to claim 1, further comprising an antibacterial agent.

3. The fiber product made of elvan according to claim 2, wherein the antibacterial agent is a Ag ion.

4. The fiber product made of elvan according to claim 1, wherein said plastic material comprises a polyester and/or an acrylic polymer.

5. Products using a fiber product made of elvan, wherein the fiber product is produced by mixing and melting elvan powder containing an antibacterial agent and a plastic material.

* * * * *